US010453313B2

(12) United States Patent
Halliburton et al.

(10) Patent No.: US 10,453,313 B2
(45) Date of Patent: Oct. 22, 2019

(54) PARABOLIC BALL LAUNCHER AMUSEMENT GAME

(71) Applicant: ACME Game Designs LLC, Boca Raton, FL (US)

(72) Inventors: Ronald Halliburton, Loxahatchee, FL (US); David Hodges, Loxahatchee, FL (US)

( * ) Notice: Subject to any disclaimer, the term of this patent is extended or adjusted under 35 U.S.C. 154(b) by 36 days.

(21) Appl. No.: 15/078,986

(22) Filed: Mar. 23, 2016

(65) Prior Publication Data

US 2017/0278356 A1 Sep. 28, 2017

(51) Int. Cl.
*G07F 17/32* (2006.01)
*A63F 9/02* (2006.01)

(52) U.S. Cl.
CPC ..... *G07F 17/3297* (2013.01); *A63F 9/0247* (2013.01)

(58) Field of Classification Search
CPC .. G07F 17/3297; G07F 17/32; G07F 17/3202; G07F 17/38
USPC ..... 273/398–402; 473/185, 170, 172
See application file for complete search history.

(56) References Cited

U.S. PATENT DOCUMENTS 4,186,926 A * 2/1980 Kulesza ..... A63F 7/00 124/79
5,074,552 A * 12/1991 Gomez ..... A63B 69/0071 273/402
5,499,821 A * 3/1996 Rycroft ..... A63F 7/0612 273/357
6,270,080 B1 * 8/2001 Chang ..... A63F 9/02 273/138.3
7,192,342 B2 * 3/2007 Shoemaker, Jr. ... G07F 17/3248 273/138.3
7,507,152 B2 * 3/2009 Halliburton ..... A63F 5/02 273/351
2008/0280661 A1 * 11/2008 Shoemaker, Jr. ..... A63F 9/0247 463/7

* cited by examiner

*Primary Examiner* — John E Simms, Jr.
*Assistant Examiner* — Rayshun K Peng
(74) *Attorney, Agent, or Firm* — IP Law Leaders, PLLC

(57) ABSTRACT

An amusement game with a parabolic ball launcher for projecting a ball that will attempt to strike a primary hoop target, which can pivot or oscillate. The primary target allows the stricken ball to fall through and attempt to hit one of the two openings on a suspended platform positioned on a rotating wheel, which has openings toward the periphery of the wheel to eventually rest the ball. The rotating wheel has programmable displays corresponding to each of the openings on the periphery of the wheel, which can be adjusted based on user input to reflect new parameters or values.

15 Claims, 8 Drawing Sheets

PARABOLIC BALL LAUNCHER AMUSEMENT GAME

PRIORITY INFORMATION

The applicants claim the benefit to U.S. Provisional Application No. 62/137,120, which was filed on Mar. 23, 2015.

FIELD OF THE INVENTION

The present invention is directed to the amusement game industry and more particularly towards the redemption game industry and for prize dispensing. Redemption games are typically skill based games. In typical embodiments, a player provides a token or credit that is required to play a game to activate a credit switch. Play is commenced and the player is awarded a prize or tickets or credits that may be redeemed for prizes or merchandise.

BACKGROUND OF THE INVENTION

There are a number of skill based amusement game that use a rotating wheel as a target including those positioned in a horizontal plane. For instance the patent to Halliburton, U.S. Pat. No. 7,507,152 ("the '152 patent") discloses a game device that have a plurality of targets or holes through the horizontal wheel. The object of the game disclosed in the '152 patent is to time the drop of a ball or game piece so that it intersects with a target hole as it passes directly under the drop location so it falls directly through the rotating wheel and second disk that also has a aperture. If the drop is unsuccessful, the ball will eventually be capture in one of a plurality of holes in the wheel, and is moved to the through hole of the underlying disk and allowed to fall into a ball retention area. The logic of the game can detect when a ball falls directly though the drop area or determine the respective other hole in the wheel. However, this second calculation, namely when the ball is capture in other locations and does not fall directly through the wheel and disk, the location of the ball is not directly calculated but rather, the location is determined by calculating the respective wheel position when the ball sensor detects when the ball is dropped through the disk aperture.

While the game disclosed in the '152 patent has been successful, because the wheel that is designed to capture balls has no sensors built into it, it therefore has no intelligence and the wheel must rotate with the ball in a hole that has been captured with a through hole to finally drop the ball through a though hole in a second disc under the wheel in order to determine discover which hole the was captured ball landed in in order to pay the tickets or points corresponding to the hole location to the player. This configuration creates a time delay and a consequential disconnect from the game play action and feedback to the player. In other words, while a player can observe a particular result, feedback to the player relating to the game conditions, which may include visual, auditory, tactile stimulation of the payout itself is delayed. In addition, in the game disclosed by the '152 patent, the time in which the ball drops from the top of the device to the wheel is relatively rapid, and therefore the player does not have much time to observe the action of the game upon the ball release.

SUMMARY OF THE INVENTION

The present invention is generally directed to a game wherein the player can time the launch of a ball that will travel in a ballistic arc or relative steep parabolic arc to try to hit a moving target along the rear of the device. A further feature of embodiments of the present invention, referred to as the smart wheel, includes a plurality of sensors positioned on the wheel which are associated with each target hole or position. Consequently, when the ball that has been launched is eventually captured in a hole or cavity in the wheel, it is immediately read by a sensor and therefore the game can provide immediate feedback to the player, in the form of sound effects, lighting effects and the activation of a ticket dispenser which can begin the distribution of tickets.

DETAILED DESCRIPTION

The present invention relates to an amusement game that operates in several modes. There are a number of modes of game play and two or more modes of operation. In addition, in embodiments, the device includes a prize ball dispenser that may be accessed in the event of successful play or in response to other operator controlled parameters.

Figure 1:
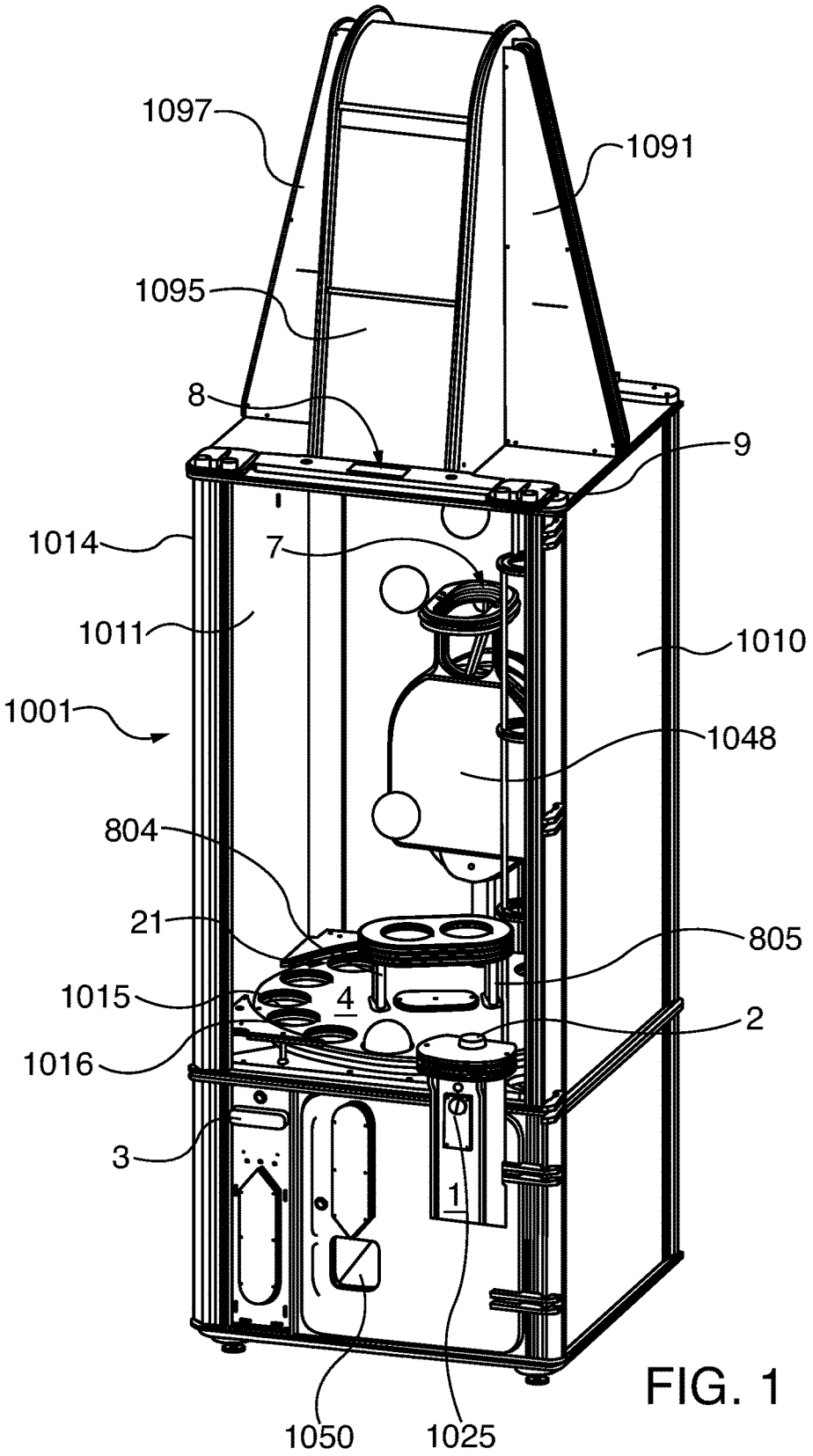
FIG. 1 is a front perspective view of an embodiment of the invention.

Now referring to FIG. 1, the game device is contained in a secure cabinet 1001 that includes transparent windows 1010, 1011 and 1014 that allow the observation of game play. In the center of the device is a horizontally mounted wheel 4 through which there a series of openings such as openings 1015 and 1016 that are sized to receive the game piece balls. On the rear of the device, an annular rim 7 is mounted on a pivoting rim assembly 1033. Game play in a first a skill mode proceeds as a player attempts to time the launch of a ball to hit the intended rim target 7. A single ball is used in the game aspect of the device. In order to launch a ball the player hits switch that causes an object to strike the underside of a ball thereby launching the ball into the air in a ballistic arc towards the moving rim 7. An object of the game is to therefore time the launch of the ball to coincide with the moving hoop to cause the ball to fall thru the primary hoop target 7 as it descends in its arc of trajectory. In a preferred embodiment, the ball launch location is between 2 to 3 feet from a location directly under the annular rim target. In the preferred embodiment the parabolic arc has a vertex about from 4 to 8 feet from the launch location (or on the y axis) and 1 to 1.5 feet in a lateral (or x axis) direction from the launch point. In another embodiment, the launch location to the opposite point on the axis of symmetry is between 1.5 and 4 feet and the vertex is between 3 and 10 feet from a line drawn between the launch point and opposite axis of symmetry.

In other contemplated embodiments, the primary target hoop may be stationary and the player may be allowed to adjust the location of the hammer strike. The primary hoop target 7 includes a detector that includes and light source and light detector (not shown). A best seen in FIG. 3, primary annular hoop 7 has an upper flat surface 335. The hoop is powered by a stepper motor 20 that provides a pivotal motion to the rim causing the rim to oscillate back and forth at a relatively constant speed, or like the motion of an inverted pendulum. The hoop rim 1 is mounted above a display board 650 that can be used to display information about the game, such as scoring information, game status, or credit information. In embodiments the display board 650 comprised an LED screen. In contemplated alternative embodiments the motion of a hoop rim may comprise lateral motion wherein the rim stays in the same horizontal plane and moves from the lateral side to side of the cabinet. In further contemplated embodiment the rim of the hoop target moves from the front to the rear of the cabinet in either a pivotal motion or in rectilinear motion. In yet further embodiments, rather than annular opening, the targets comprise pressure activated switches that are engaged by the balls.

Figure 2:
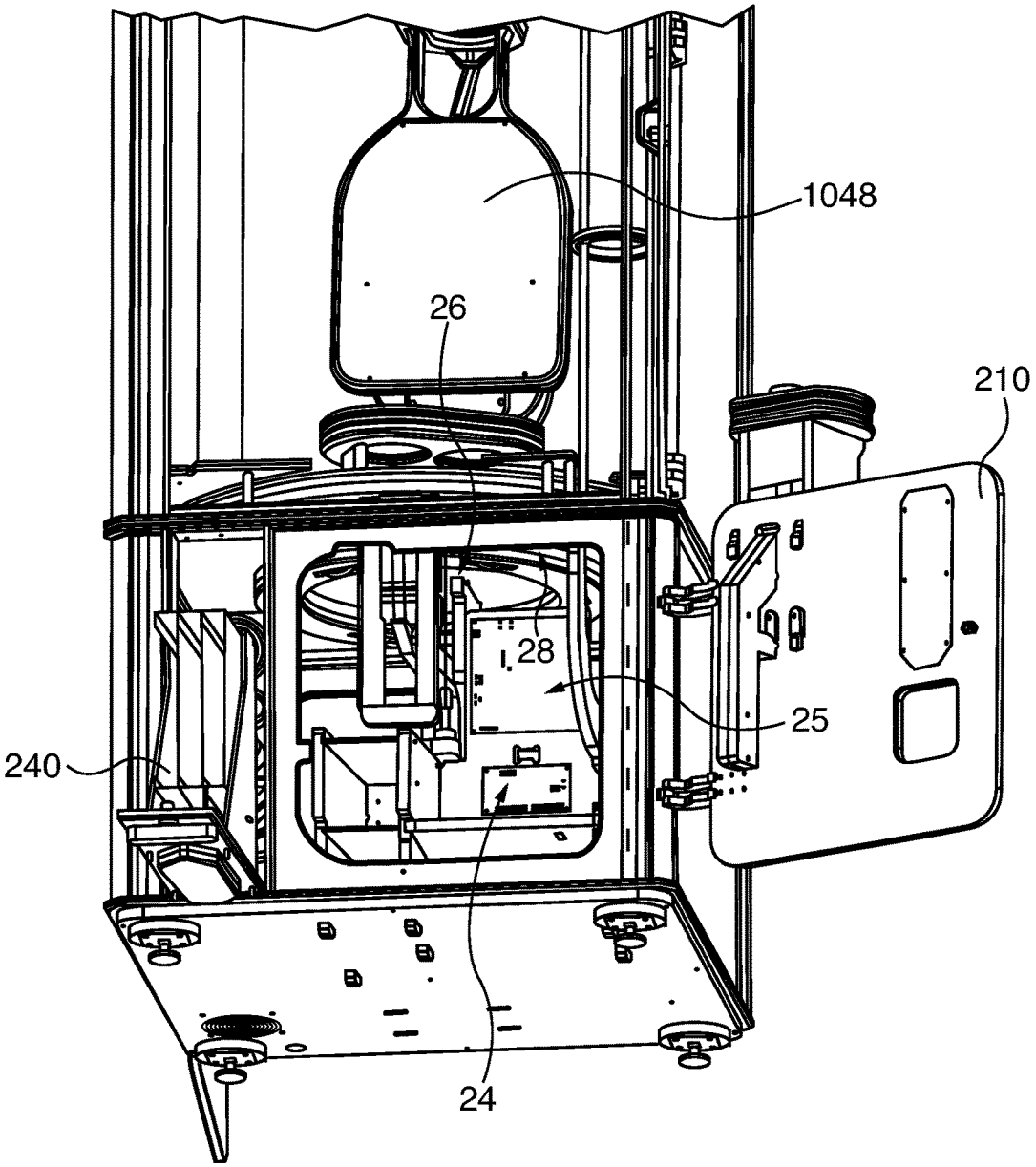
FIG. 2 is a front perspective view of an embodiment of the invention with the access door in an open position.

Referring now to the embodiment depicted in the FIGS. 1-8, if the player misses the primary hoop, the ball can nevertheless fall into a secondary target array on platform 8 that rotates as the lower wheel 4 rotates. The second target array 8 includes two openings 802 and 803 that pass through a suspended platform positioned above the rotating wheel by legs 804 and 805. The opening and which may receive the balls and allows balls to pass through the openings. As a ball passes through it is detected by a sensor. In the preferred embodiment, the sensors comprise a light source, such as an LED and a light detector. As a ball passes through a space between the light source and the detector, the signal from the detector is interrupted and the CPU interprets the signal as a ball that has passed through the platform target. Holes 804 and 805 are mounted on platform surface 5 above the wheel to give clearance so that a ball falling thru a hole will fall onto the wheel and through centripetal force find its way to the rim of the wheel falling into a hole. As seen in FIG. 1 above the cabinet are support members 1091 and 1097 that support a clear panel that provide a to allow the vertex of the line of flight of the ball to extend above the cabinet. FIG. 1 also depicts the prize ball dispensing area 1050 and a ticket dispenser 3. This embodiment uses tokens which are inserted into coin acceptor 1025. Referring to FIG. 2, the ticket dispenser 3 includes ticket magazine 240. In this view, the front access panel 210 is opened and the power distribution board 24 and the main processor board 25 can be seen. Element 26 is the ring commutator board that transfers power to the wheel element 4.

A second game mode consists of the ball after it has fallen past the primary and secondary targets to continue on bouncing and rolling around in a random fashion on the wheel until it lands in a tertiary target. Once the ball rests in a hole on the periphery of the wheel it in sensed by a sensor located in each hole to determine which hole the ball has landed in. The holes in the periphery of the wheel 4 are at a diameter as such that the ball will not pass through.

Wheel 4, referred to herein as a "smart wheel, and has a number of sensors associated with each hole to indicate what has happened in regards to the ball. In addition, the wheel is powered from the game power supply through a brush commutation means or a coil to coil transformer to provide electrical current to the wheel so that it may rotate continuously without loss of electrical current. Wheel 4 transmits the results of the ball sensor activity, a determined by the ball sensors to the main game board thru RF and optical means. There is no (home sensor) or start point for the wheel and, unlike the Halliburton prior art device, no steps are counted to determine wheel position to indicate what hole the ball has landed in.

Figure 7:
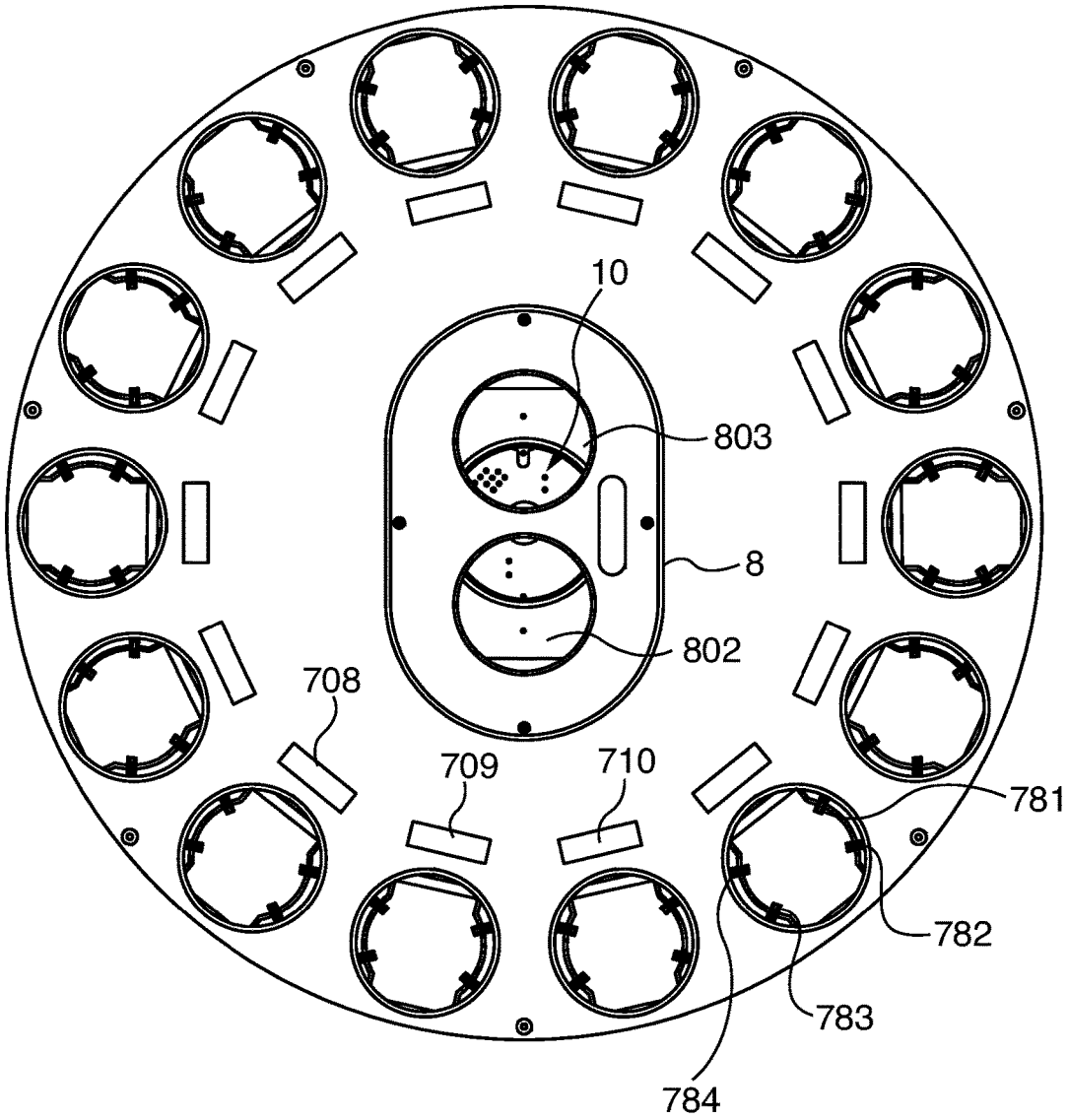
FIG. 7 is a top view of the wheel and platform.

Still referring to FIG. 7, each hole in the wheel has three or more rollers such as 781, 782, 783 and 784 around its edge for the ball to rest. This provides a very low friction point for the ball as the ball will expand upon being hit by hammer 14 or other object striking the ball underside. Without means of reducing the friction around the ball resting in the wheel, the ball will expand as it is struck and bind creating an uncontrollable ball causing an undesirable inaccuracy of the ballistic arc thus rendering the skill part of the game useless. The commutation brush holder board 10 is visible through the secondary targets holes 802 and 803 provided through platform 8. A display 906 is also provided on platform 8.

The modes of operation provide the player with one or more ways of winning. The player may win tickets or a ball or both depending on the location type the game is in or the way the game is set up by the operator of the game.

Referring back to FIG. 1, in order to play the game, a player inserts coins, tokens, money, a credit card or other means to activate credit detector 1. Upon the detection of sufficient credit, a ticket board is activated and device is ready for play. At this point the target wheel in the game comes to a stop from the end of the last play or is already in the stopped and is ready in a ready position to launch the ball position. This condition is determined by two infrared led associated with a hole in the playfield having a ball resting in it.

Figure 3:
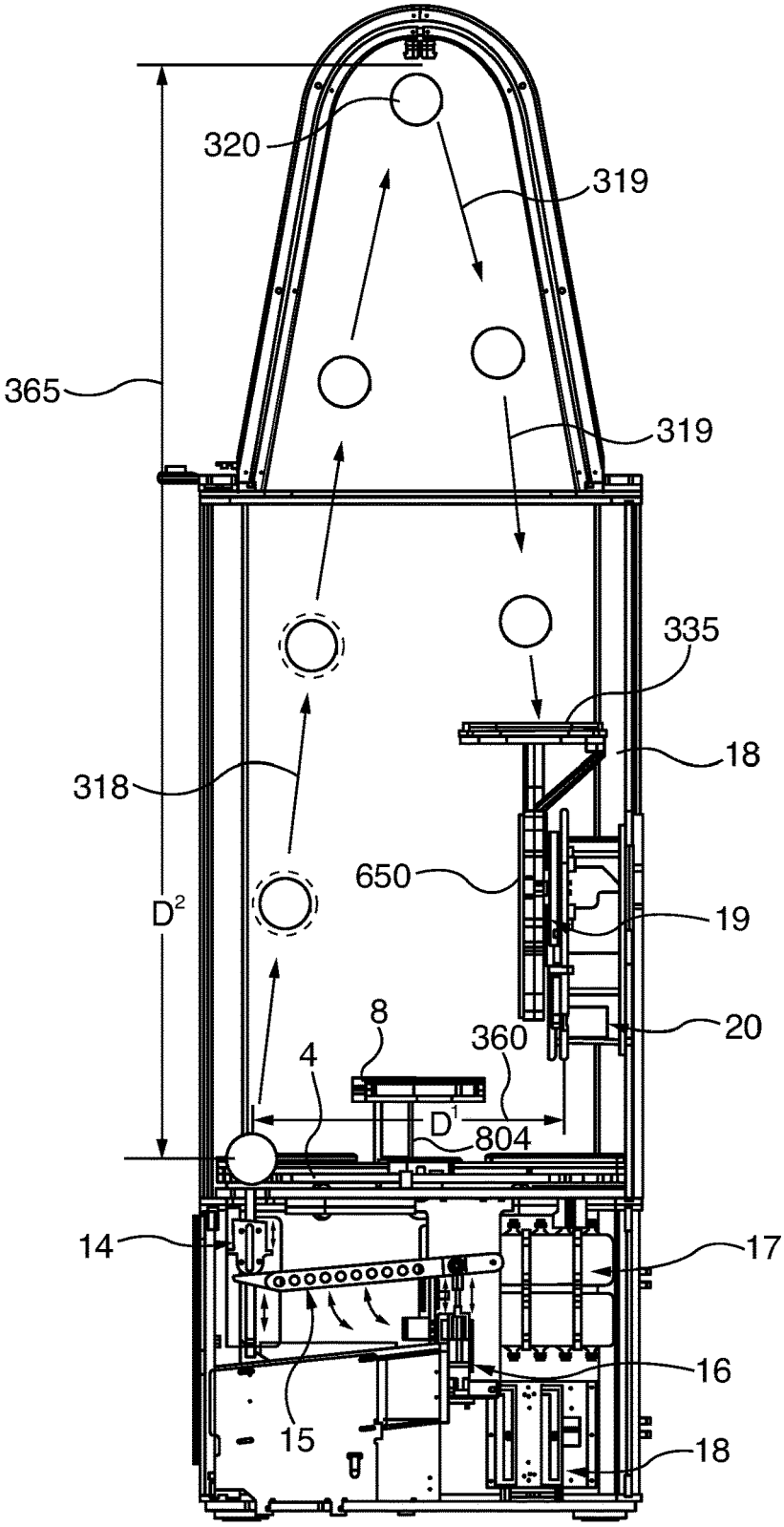
FIG. 3 is a side sectional view in elevation of the embodiment of FIG. 1 that depicts an exemplary of flight game pieces from the launch location to the primary target.

If the IR led are sensed lined up by two sensors under the wheel (not shown) then the game is armed and ready for ball launch. At this point the game provide an audible signal transmitted by speaker 9 and illuminates a steady button light that indicates that the launch is ready to go. The player then times his shot and hits the launch button 2. Upon activation of the launch button 2, a signal is transmitted to the central processor in the main board at which time sends a 300 MS pulse to an air valve in hammer pivot arm pneumatic cylinder 16. Cylinder 16 is connected to a regulated air supply that allows pressurized air to flow thru a tube into the pneumatic cylinder actuator 16. As seen in FIG. 3, a pressurized air supply 17 for the cylinder 16 is used for the ball launcher feature.

When activated, pneumatic actuator 16 to move lever 15 that is located under hammer 14 which will rapidly move upward towards the underside of the ball that is seated in wheel 4. As the hammer strikes the ball, the ball will rapidly rise into the air in a ballistic arc as illustrated in FIG. 3. At about 500 MS after the ball is launched the wheel begins to rotate at a predetermined speed. As the ball follows its arc it may or may not be timed properly to fall through the hoop. If the ball falls thru the hoop 335, then audible sound is played as well as lights surrounding the hoop to change color or flash indicating a ball passed through. Also shown in FIG. 3 is the path of the ball that is depicted by broken line 3 with a series of balls in the flight path. The game uses a single ball and the illustration depicts the ball at different times. Also shown are lines D1 (reference 360) which depicts the distance from the launch point to a point on the x axis opposite the launch. In the embodiments shown, D1 is between 2 and 5 feet, and D2 (reference 365) depicts the vertical distance from the launch point to the vertex. In the preferred embodiment, D2 is between 3 and 6 feet, and the vertex of the parabolic path is at 320.

Game play may be configured to allow a player to play for free until the player misses the hoop with a predetermined number of consecutively shots. In an embodiment, after a predetermined number of consecutive hoop passes, the player is provided with a big ticket wins as well as the ability to win a ball.

As a ball the continues past the hoop in a gravity induced free fall, it will bounce around and possibly fall through one or more of the target holes 802 or 803 in the platform 8. In the embodiment depicted herein, two secondary target holes are provided, a first hole 802 for a ticket jackpot and a second opening 803 to win a prize ball. The secondary targets are provide with optical sensors within the platform mounted above the wheel and then eventually onto rotating wheel 4. In yet a further embodiment, additional secondary targets may be provided.

Figure 4:
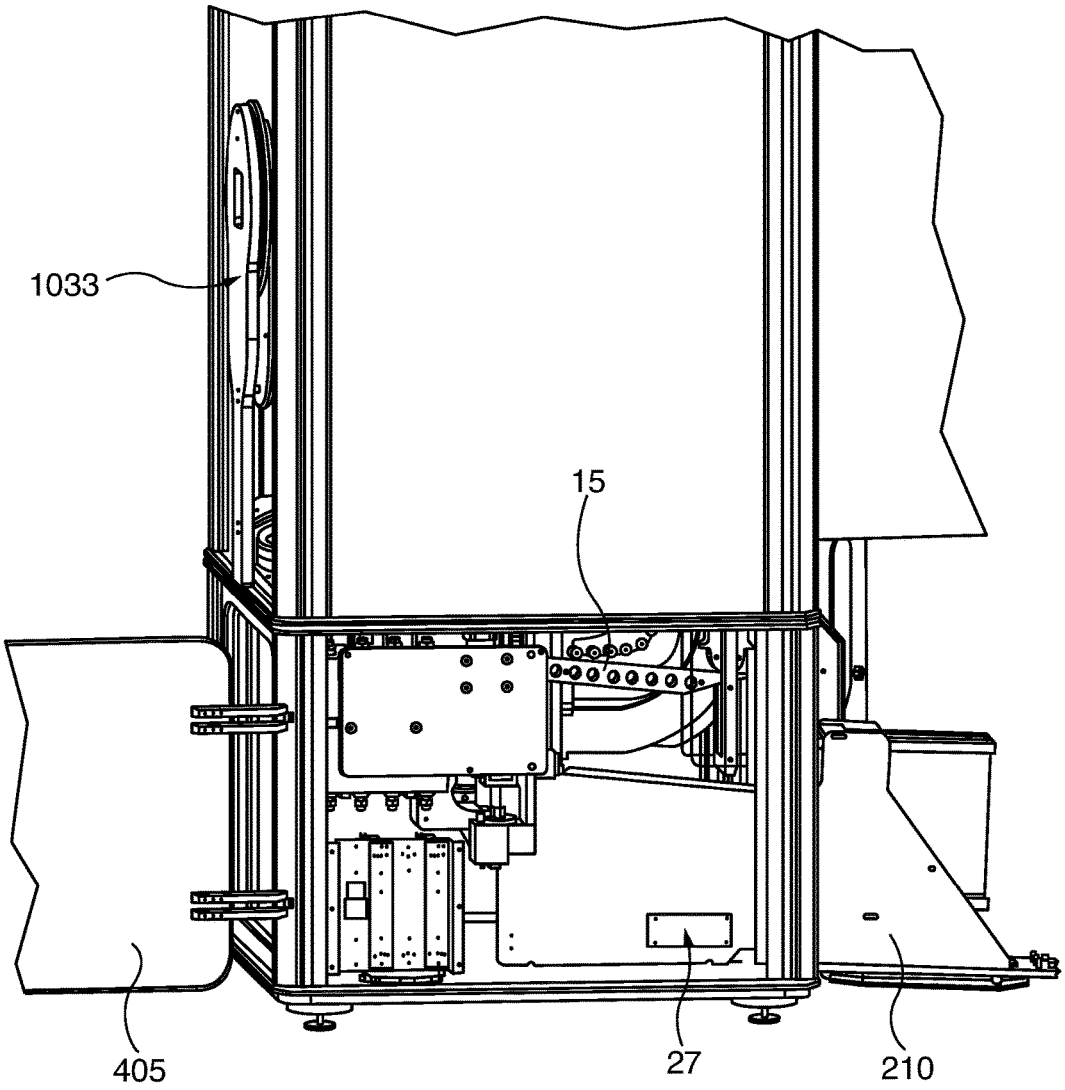
FIG. 4 is a partial side sectional view in elevation of the embodiment of FIG. 1.
Figure 5:
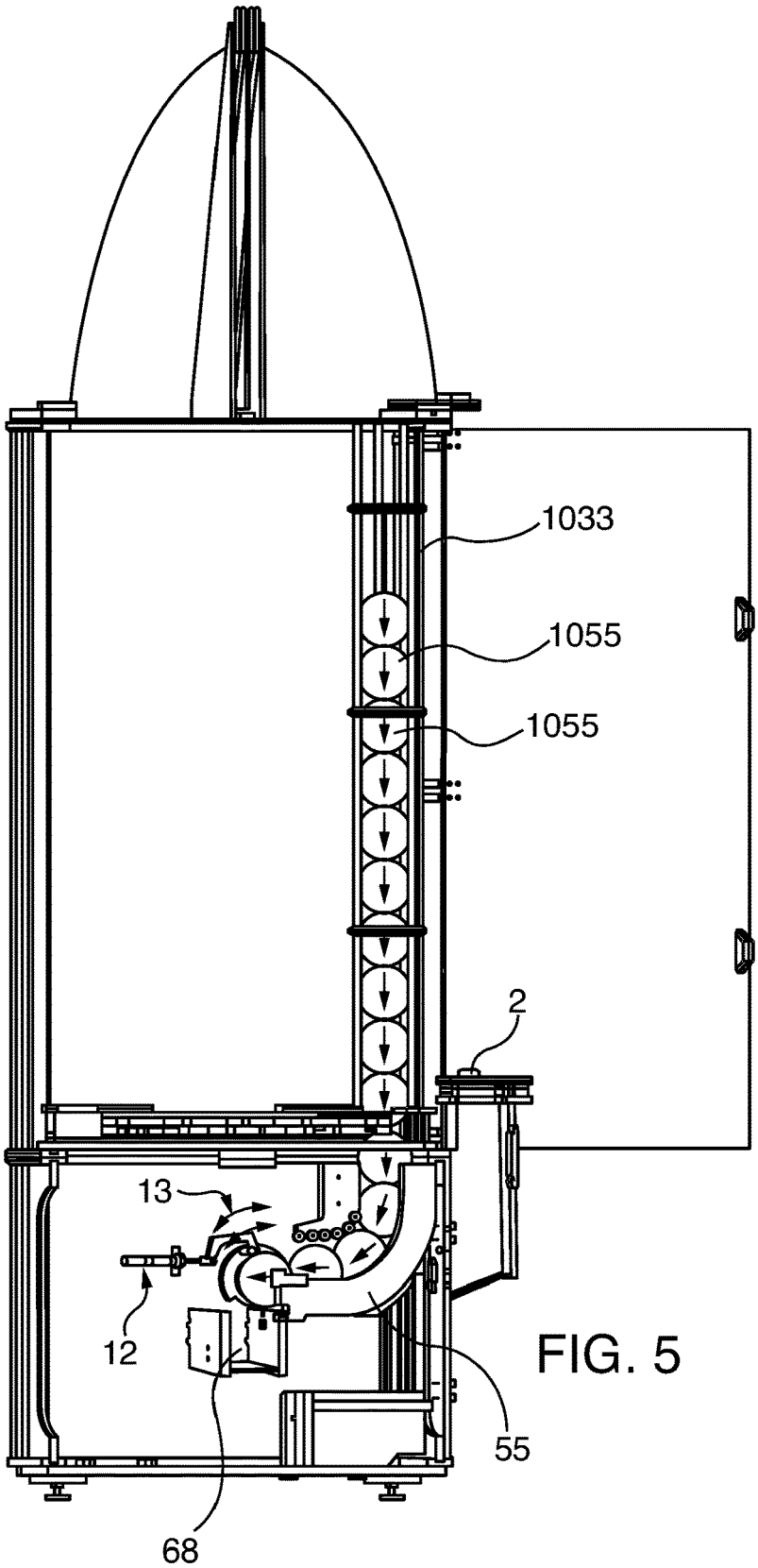
FIG. 5 is a front sectional perspective view of the ball dispensing aspect of the invention with the ball launching aspects removed from view with the front door of the cabinet in an open position.

FIG. 4 depicts a side view of the device including lever 15, ticket dispenser interface board 27; ticket magazine side surface 201 and rear access panel 405. Also depicted in FIG. 4 is the rear access panel 405 and of the rim target assembly 1033.

Figure 6:
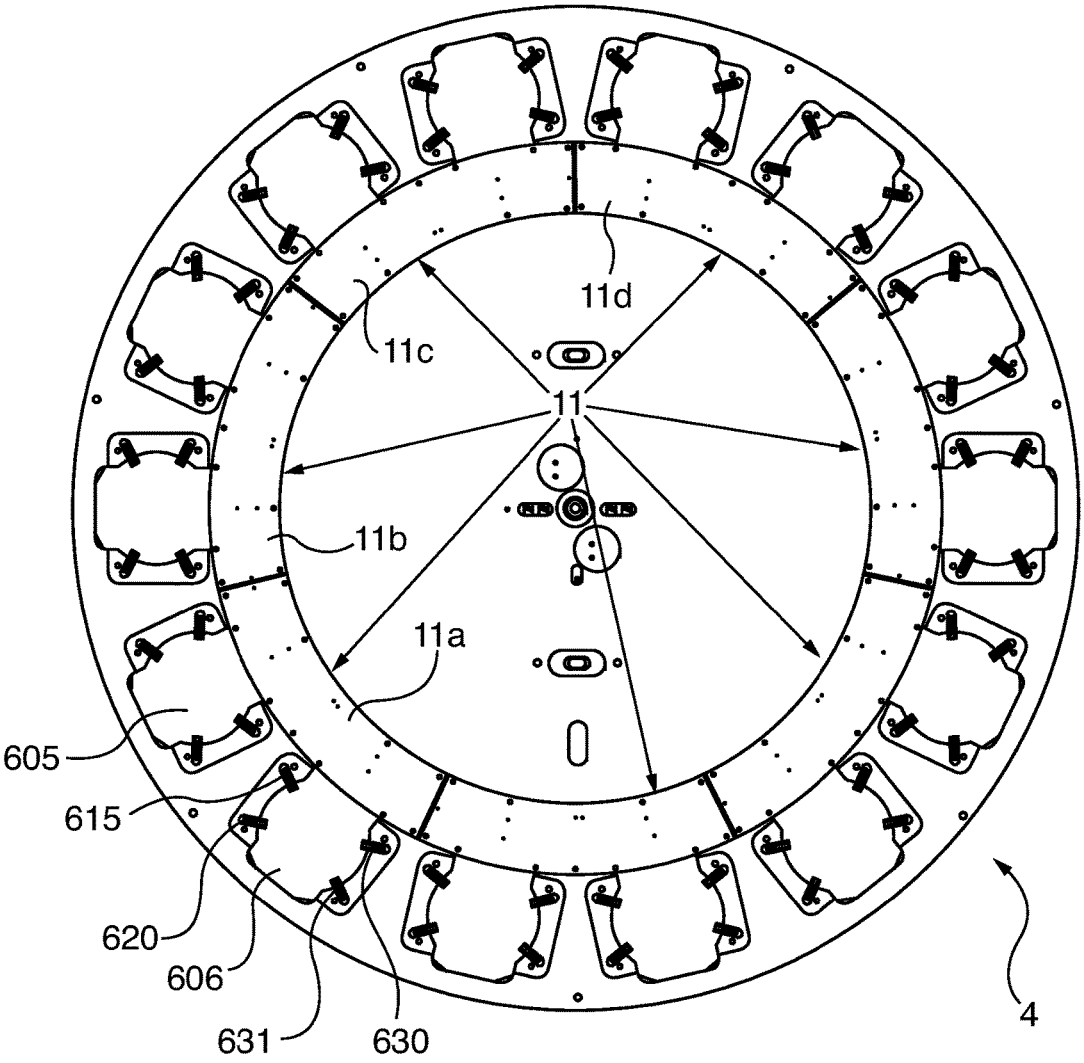
FIG. 6 is a bottom view of the wheel.

Now referring to FIG. 6, wheel 4 is preferably built in intelligence wireless and optical communication with the main board can indicate what sensors have been tripped in order to immediately begin payout to the player even as the wheel is rotating into position for the next ball launch. As a ball eventually rests in a hole on the periphery of the rotating wheel two optical transmitters (IR LEDs) in this case turn on to indicate which hole the ball is resting in. This in turn is sensed by two IR receivers and transmits this information to the main control board via wires to stop the wheel in the correct location for the next play positioning the ball over the hammer with precise alignment. FIG. 6 depicts exemplary aperture 606 which is associated with four rollers 615, 620, 631 and 630. A number of circuit boards such as 11*a*, 11*b*, 11 support the ball sensors in the wheel 4 (not shown).

The computer controlled stepper motor reverses the wheel direction after passing the two IR LEDS in order to align the wheel for an accurate ball launch.

In the embodiments, through optical, radio or both communications, information from the wheel and other target sensors can be sent immediately to the main control PCB to initiate feedback such as sound, lights, and ticket or point payout to the player thereby creating a more fulfilling game experience for the player. A further feature of the smart wheel aspect of the invention is the ability of the game owner and operator to easily adjust and display alternative scoring parameters. One drawback of some of the prior art games that used such horizontal target wheels is that the target values for each hole was static. The values associated with each hole the wheel could not be easily changed or altered unless the artwork on the wheel as well as programming associated with the different values by the owner or operator of the game are were made. In particular, these prior art wheel arrangements creates tremendous difficulty when the market for such games is conducted in different locations and in different countries throughout the world.

Accordingly, in connection with the embodiments, and because the smart wheel technology that is associated with the holes, as seen in FIG. 7 there is also a programmable led display such as 708, 709 770 for each of the 14 targets around the periphery of the wheel. Although the use of LEDs is a preferred method the same programmable displays may be accomplished by using different types of display technology. This feature provides a manner in which to change the values of the targets on the wheel via a simple user input. The display output can depicted whatever values one what's on the wheel without the need for new artwork or special programming. Power is transferred to the rotating wheel 4 using a commutator brushes.

In addition the values of the targets can be automatically changed, either a function of a predetermined algorithm as game play proceeds. On information and belief, this feature was not disclosed in the prior art and was not possible in the prior art known to the applicant because the prior art used a static wheel design.

Yet a further benefit to the smart wheel technology is that it provides the ability to rapidly auto loading the ball for the next ball launch or shot. In this regard, prior art games had to bring the ball back to a drop position by means of a lift that would return the ball back to a storage position so that the ball may be later dropped back onto the rotating wheel for the next play. The wheel of the present invention provides a sensing function as well as the means to bring the ball back to the launch or shoot position without any other means of lifting the ball back into position for the next play. The wheel according to this embodiment of the invention positions the ball into location, senses the ball and then transmits this information to the main board to coordinate the wheel for the next play.

As best seen in FIG. 3, instead of a ball dropping onto the wheel from above like many of the prior art references, the ball is positioned in wheel 14 so that the ball resting on the wheel is hit on the underside by a hammer 14 from below the wheel causing the ball to launch up into the air in a ballistic arc into a moving target hoop and then falling onto the rotating wheel sensed by the wheel as to where the ball is located and finally positioning by the wheel for the next play. In this embodiment the same ball is used over and over again for game play.

In the embodiments, a built in wireless communication capability is provided wherein the game owner or operator may make changes to the game by means previously not used in any other game of this type. In addition, the owner or operator of the game may check accounting, make changes to game settings as well as be informed by the game as to the statues of the game such as operating errors/malfunctions as well as accounting information in real time.

Figure 8:
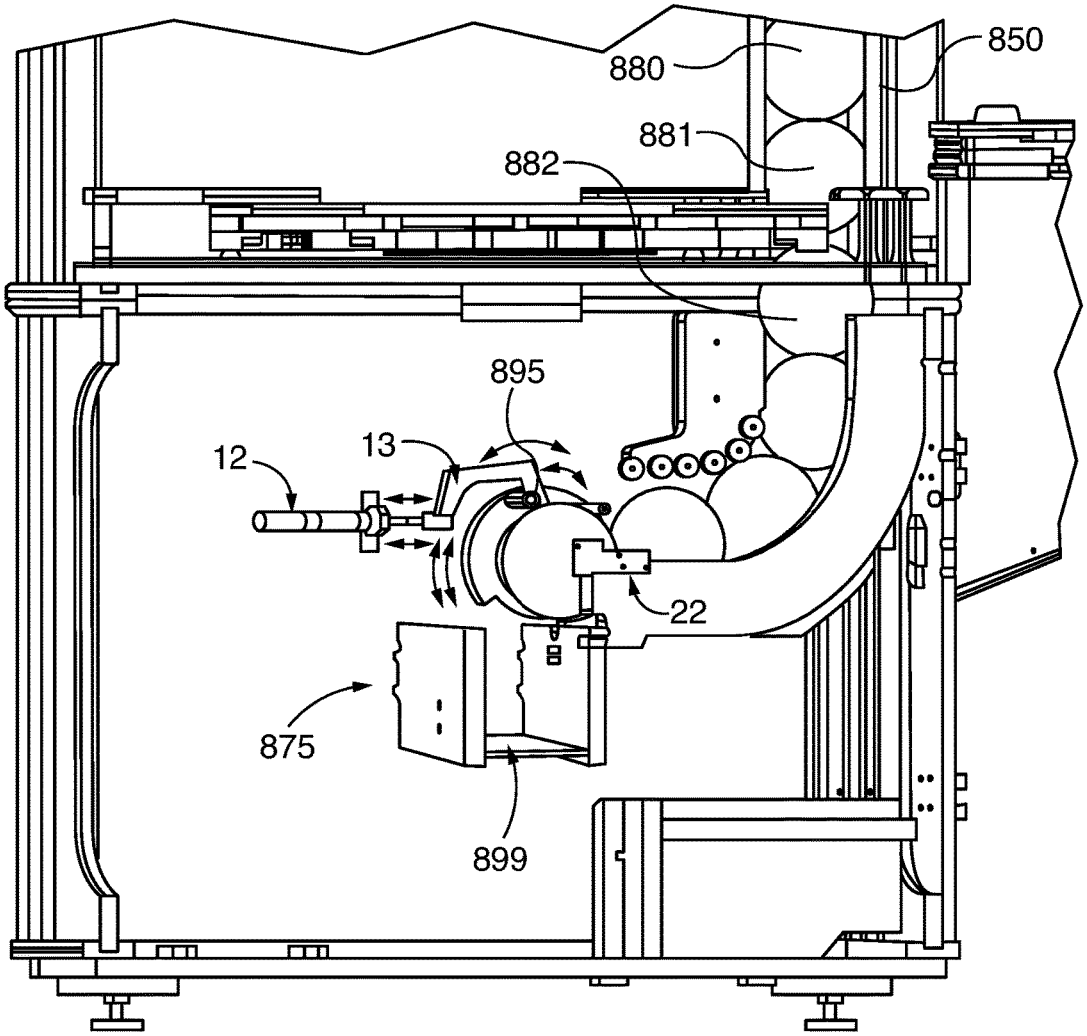
FIG. 8 is a sectional view in elevation of the ball dispensing aspect of the invention.

Now referring to FIG. 8, the one aspect of the device includes a prize dispenser. After successful play as determined by the operator such as (1) in the event that a player reaches a threshold point value or (2) the player make a predetermined number of successful hits of the primary target in a row, the player may optionally be awarded a high impact prize ball. Prize balls such as balls 880 881 and 882 are stored in a vertical magazine 850. The magazine is located within the secured cabinet and is intended to be periodically replenished with an inventory of prize balls by the owner or operator. The owner or operator may unlock the cabinet and stock additional prize balls into the top of the magazine 850. Balls are gravity fed to the dispenser mechanism 875. Dispenser mechanism 875 includes a ball sensor 22, ball dispenser air cylinder 12, ball dispenser control arm 14. In response to a signal from the central processor, air dispenser 12 causes control arm 30 to rake a ball in a rectilinear direction to engages a ball that has come to rest at the terminal end of the magazine and which is stopped from further movement by member 895. Ball Dispense sensors detect the presence of a ball in the cylinder. In the event that no balls are sensed at the location the can transmit s signal to the central processor to alternatively awarded tickets from the ticket dispenser in response to a winning score. In addition the central processor may and a wireless signal to the operator to alert the operator that the prize ball magazine is empty. In an alternative mode of operating the prize ball dispenser can be configured to dispense prize balls in response to the device receiving sufficient credits.

Although the present invention has been described with reference to the preferred embodiments thereof, as well as the best mode of carrying out the present invention, it is apparent to those skilled in the art that variety of modifications and changes may be made without departing from the scope of the present invention which in intended to be defined by the appended claims.

What is claimed is:

1. An apparatus for operating an amusement game in a secure cabinet, comprising: a game piece; a launch device for projecting said game piece; said launch device comprising a switch to activate a stationary launcher element to impose a force on said game to propel said game piece in a repeatable and predictable parabolic trajectory wherein it freely travels through the air, unguided in a parabolic path upwardly past the position of a target opening and then, from an apex, downwardly towards said opening, a pivotable primary target that moves back and forth along an arc in a vertical plane by pivoting on a horizontal axis, said target having at least one primary target having a passage with an opening facing upwards when positioned at the apex of said arc, and sized to allow said game piece to pass through, and allowing said game piece to vertically fall through said passage of said primary target; a rotatable secondary target wheel having a plurality of secondary targets for receiving said game piece, and allowing said game piece to vertically fall through said secondary targets; wherein said primary target is located above said secondary target wheel and said targets are located at radial positions on said wheel, and wherein said launch device is located below said target opening of said passage of said primary target.

2. The apparatus of claim 1, wherein the primary target, and the secondary section further comprising sensors for detecting said game piece as it passes said primary and secondary targets.

3. The apparatus of claim 2, wherein said sensors further comprise a light source and a sensor.

4. The apparatus of claim 1, wherein said launch device switch further controls an air valve on a pneumatic cylinder for causing a hammer pivot arm to strike said game piece and cause said game piece to project in a ballistic or parabolic arc.

5. The apparatus of claim 1, wherein said primary target comprises an annular hoop mounted to allow said hoop to pivot or oscillate about said horizontal axis.

6. The apparatus of claim 5, further comprising a motor wherein said primary target is connected to said motor to provide for pivoting or oscillating motion.

7. The apparatus of claim 1, wherein said wheel further comprises a plurality of programmable displays corresponding to each of said plurality of openings, and each of the programmable displays can be adjusted through a main control circuit.

8. The apparatus of claim 1, further comprising a secure cabinet containing said primary target, said launch device and at least one game piece and said cabinet further comprises transparent panels.

9. The apparatus of claim 1, further comprising: a display board positioned adjacent to said primary target for displaying amusement game information; a credit detector for accepting a payment from one or more coins, tokens, or credit cards; and a ticket dispenser for dispensing an award ticket.

10. The apparatus of claim 9, wherein the ticket dispenser includes a ticket magazine, a power distribution board, a main processor board, and a ring commutator board that transfers power to the wheel.

11. A method for operating an amusement game in a secure cabinet, comprising:

launching a game piece with a game piece launch device having a switch;

receiving said game piece through a moving primary target comprising an opening to a passage, said opening oriented to face upward, and allowing said game piece to vertically fall through said primary target;

detecting said game piece as it falls through said passage, receiving said game piece with a moving secondary target, and allowing the game piece to vertically fall through the secondary target; and wherein said primary target is located above said secondary target, detecting the game piece as it passes through said through said secondary target and wherein said game piece launch device is stationary and located below said opening of said passage of said primary target and launches said game piece in a parabolic arc so that it freely travels through the air, unguided in a parabolic path upwardly past the position of said opening and then, from an apex, downwardly towards said opening.

12. The method of claim 11, wherein said secondary target is provided on a horizontal wheel that comprises a plurality of openings that face upwardly.

13. The method of claim 12, further comprising the step of oscillating the primary target and said target wheel simultaneously.

14. The method of claim 11, further comprising the steps of accepting a payment, displaying amusement game information, and dispending an award ticket.

15. The method of claim 11, further comprising the step of displaying information related to the game piece on the wheel section and adjusting each of the displays through a programmable control circuit.

* * * * *